United States Patent [19]

Provence et al.

[11] Patent Number: 4,900,052

[45] Date of Patent: Feb. 13, 1990

[54] CROSS-COUNTRY SKI BINDING

[75] Inventors: Marc Provence, Annecy le Vieux; Didier Rousset, Lescheraines; Josiane Dunand, Cran Gevrier, all of France

[73] Assignee: Salomon S.A., Annecy Cedex, France

[21] Appl. No.: 122,857

[22] Filed: Nov. 17, 1987

[30] Foreign Application Priority Data

Nov. 17, 1986 [FR] France ..... 86 15946

[51] Int. Cl.[4] ..... A63C 9/18

[52] U.S. Cl. ..... 280/615

[58] Field of Search ..... 280/615, 626, 631, 634

[56] References Cited

U.S. PATENT DOCUMENTS

| | | | |
|---|---|---|---|
| 2,649,306 | 7/1951 | Hilding | 280/614 |
| 3,003,777 | 10/1961 | Hilding | 280/614 |
| 4,083,578 | 4/1978 | Moog et al. | 280/618 |
| 4,266,805 | 5/1981 | Weigl | 280/615 |
| 4,309,833 | 1/1982 | Salomon | 36/117 |
| 4,402,525 | 9/1983 | Salomon | 280/628 |
| 4,647,064 | 3/1987 | Salomon et al. | 280/615 |
| 4,714,267 | 12/1987 | Abondance et al. | 280/615 |

FOREIGN PATENT DOCUMENTS

| | | | |
|---|---|---|---|
| 0167462 | 1/1986 | European Pat. Off. . | |
| 2399856 | 3/1979 | France . | |
| 2424037 | 11/1979 | France . | |
| 2439602 | 5/1980 | France . | |
| 2591120 | 6/1987 | France | 280/615 |

*Primary Examiner*—David M. Mitchell
*Assistant Examiner*—Tamara L. Finlay
*Attorney, Agent, or Firm*—Sandler & Greenblum

[57] ABSTRACT

A cross-country ski binding arranged to improve the ability of a skier to keep the skis in the tracks and to permit the skier to perform skating steps. The binding includes a cylindrical pin mounted in a bearing surface, such as an upper longitudinal rib of the ski, and having at least one portion complementary with at least one portion of the sole of a ski boot whereby the portion of the binding and the portion of the boot are engaged when the boot is affixed to the ski by the binding. At least one compressible member is associated with the pin so that as the pin and the boot connected thereto rotate, a return moment is created as the heel is lifted from the ski during cross-country skiing which compresses the compressible member thereby urging the boot towards the position whereby the boot is substantially flat on the ski.

66 Claims, 3 Drawing Sheets

CROSS-COUNTRY SKI BINDING

BACKGROUND OF THE INVENTION

1. Field of the Invention

The present invention relates to a cross-country ski binding, and particularly to a binding of a type adapted to cooperate with the front end of a ski boot.

More specifically, the ski binding of the present invention includes a rectilinear pin adapted to support the end of the boot equipped with means forming a guidance bearing for the pin adapted for rotation around an axis with respect to a ski. The ski binding of the present invention preferably includes means for retaining the end of the boot on the ski composed of a transverse member adapted to engage positioned beneath the end of the boot, and at least one arm adapted to extend laterally adjacent the end of the boot and to ensure the mounting of the transverse member for free rotation around the axis with respect to the means forming the bearing.

2. Discussion of Background and Material Information

A binding of the type described above is generally disclosed in French Application No. 2 399 856 with regard to FIGS. 10–13. French Application No. 2 399 856 provides an embodiment whereby the pin and retention means are made of a single element which is free to rotate with respect to the means forming the guidance bearing. The binding described in this document has, as a result, a simple structure, which is easy and economical to produce. However, the binding has a substantial disadvantage in that nothing is provided to ensure an elastic return of the boot and of the ski towards a relative position in which the boot rests substantially flat on the ski. Another disadvantage of such a binding is that it is difficult to maintain the ski in the track and that skating steps are not possible.

SUMMARY OF THE INVENTION

It is therefore an object of the present invention to provide a ski binding in which the boot and ski are urged toward a position in which the boot rests flat on the ski. The structure of the binding enhances the ability of the skier to keep the skis in their tracks and also permits skating steps to be easily performed by the skier.

The binding of the invention has a pin mounted for rotation on the ski, which has at least one surface that is arranged to cooperate with a complementary surface on the sole of the boot so that the boot can rotate with the pin. In addition, the binding includes a return means which is arranged to cooperate with the pin in a manner so that as the pin rotates by virtue of the complementary surfaces rotation and urges the boot to a position in which the boot is substantially flat on the ski.

The binding of the present invention also includes a retention means which is arranged to rotate with the pin from a first position wherein the retention means permits the boot to be placed upon the ski to a second position in which the retention means engages the upper surface of a boot to retain the boot on the ski.

In a preferred embodiment, the retention means includes a pair of arms which, together with a transverse member, affix a front portion of the boot to the pin. This configuration permits the heel of the boot to pivot around the pin during cross-country skiing.

In another preferred embodiment, the pin is journalled for rotation in a rib which is located along an upper longitudinal axis on the top surface of the ski. Projecting from either side of the rib are the respective complementary surfaces of the pin which engage respective surfaces of the front end of the boot. Within the rib and communicating with the bearing for the pin is the return means which includes at least one compressible member that acts upon at least one of the surfaces of the pin to urge the pin and concomittantly the boot to the position in which the boot is substantially flat on the ski. In a more preferred embodiment, a piston member which acts upon the surface of the pin is provided between the surface of the pin and the compressible member.

In a further embodiment, the retention means includes a reinforcement member which, preferably, is concave upwardly for permitting the skier to effect rotation of the retention means to thereby permit the skier to disengage the boot from the binding.

BRIEF DESCRIPTION OF DRAWINGS

Other characteristics and advantages of the invention will become clear from the description below, with reference form an integral part of the description in which.

DESCRIPTION OF PREFERRED EMBODIMENTS

Figure 1:
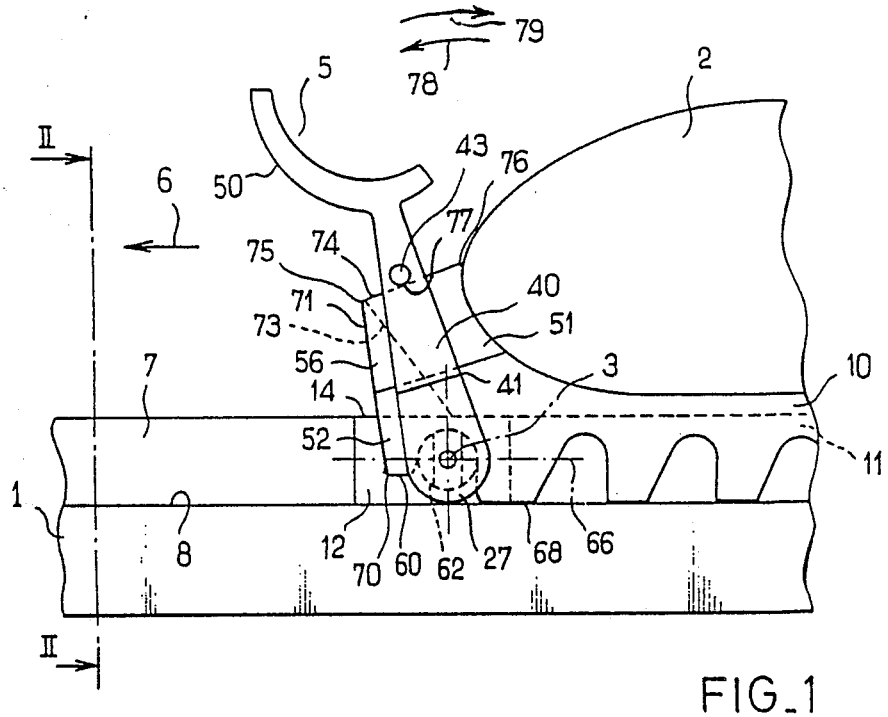
FIG. 1 shows, in lateral elevation, a view of a binding according to the invention wherein the boot is inserted in the binding of the ski, the boot being retained by the binding resting flat on the ski.

The object of the present invention is to overcome the disadvantages mentioned above. To this end, the present invention is directed to a cross-country ski binding which is characterized in that a pin is freely mounted for rotation around an axis transverse to the ski, and has at least one radial engagement and removable affixation portion complementary in shape to the end projection of the boot and in that there is provided an elastic return means for the pin to urge rotation of the boot about the axis, with respect to the bearing means for the pin, towards a preferred position corresponding to a position in which the boot rests flat on the ski. This configuration tends to maintain the ski in the track, and skating steps become possible.

The return of the boot to a position in which the boot rests substantially flat on the ski is particularly advantageous because the force is applied directly by the pin to the front end of the boot, without causing ratcheting of the transverse member of the retention means, which may have a certain elasticity, from the end projection of the boot.

Notwithstanding the previously discussed advantages, the binding according to the invention is of relatively simple construction, particularly when the arm of the retention means is mounted directly on the pin to be freely rotatable around the axis.

Preferably, the retention means includes a second arm adapted to extend laterally adjacent the front end of the boot opposite the first arm to define a U shape with the latter and the transverse member. The pin is likewise freely rotatable about the axis with respect to the second arm which, preferably, can be mounted directly on the pin, and be freely rotatable about the axis, in a manner similar to the first arm. The transverse member is thus advantageously freely rotatably mounted for rotation with the pin about the axis as well as with respect to the means forming the bearing, i.e., with respect to the ski.

In a particularly simple and economical manner the radial engagement and removable affixation portion for the front end of the boot includes at least one flattened section of the pin, which is complementary to an opening in the end projection of the boot. Additionally, the pin can include at least one flattened region, and a compressible elastic means can be located in the means which forms a bearing and engage this flattened section.

In a particularly preferred manner, the means which forms a bearing and/or the compressible elastic means, is located within a rib mounted on the ski so as to shelter as much as possible the means with respect to the snow. The portion of the binding thus constructed that projects from the ski is therefore limited to the retention means which reduces the dangers of accumulation of snow which would otherwise resist the operation of the binding. The rib can either be integrally formed with the ski or be applied thereto, and can likewise either be positioned only in the zone of the binding or extend in front and/or in the rear thereof, according to a technique known in itself in the ski manufacturing field.

FIGS. 1, 2, 5 and 6 illustrate a longitudinal ski 1 with respect to which a boot 2 is or can be journalled around a transverse axis 3, perpendicular to a median longitudinal plane 4 of the ski, by means of a binding 5 according to the invention.

For definitional purposes it will be assumed that ski 1 rests substantially flat and horizontally on the ground and reference will be made to such a position. Likewise, reference will be made to a normal longitudinal direction 6 of displacement of the ski, from rear to front. The indications of the level and orientation which will appear below are in no way limiting with respect to the position in which a binding according to the invention can be utilized, and should be considered only as relative position indicators of the different elements described.

Ski 1 illustrated by way of non-limiting example is of the type including an upper longitudinal rib 7 extending for the major portion of the length of the ski and forming an integral portion therewith, between two longitudinal surfaces 8 and 9 of the upper surface which, in an area localized in the immediate proximity of binding 5 can be considered as planar and coplanar. In a complementary fashion, boot 2 has a smooth sole having a longitudinal groove 11 therein, which is continuous and is adapted to mate with rib 7 to allow boot 2 to occupy the position illustrated in FIGS. 1 and 2, in which sole 10 rests flat on surfaces 8 and 9 of the upper surface of ski 1, respectively, on both sides of rib 7. Such a design is known in and of itself, and one does not go beyond the scope of the present invention by adapting another boot to render the boot suitable for purposes of the present invention. The rib 7 can, for example, be reduced to a localized projection in the immediate vicinity of binding 5 and, for example, be applied to the ski with the sole purpose of ensuring the mounting of binding 5 on the ski.

Figure 2:
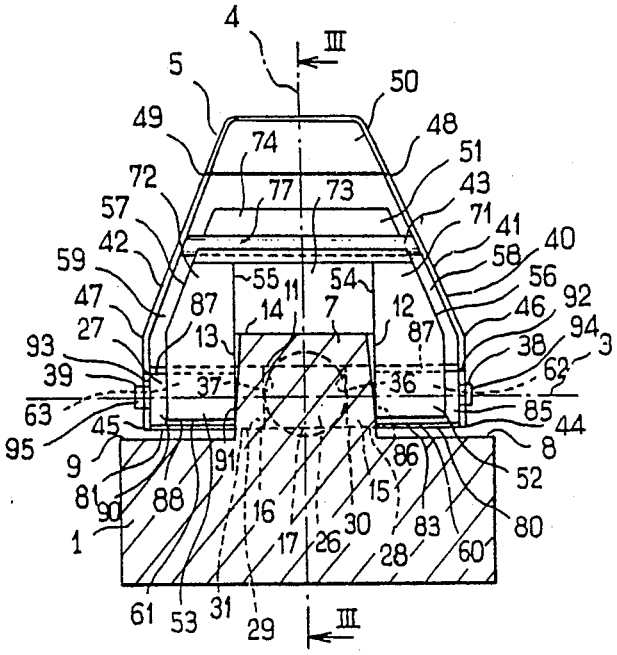
FIG. 2 illustrates a front view, in cross section through a plane identified as II—II in FIG. 1 and transverse with respect to a longitudinal median plane of the ski.

To this end, rib 7, whose cross section in this case is, for example, trapezoidal and converges upwardly as seen in FIG. 2, where the rib or projection 7 has, at least in a localized fashion with respect to binding 5, two side surfaces 12 and 13 symmetrical to one another with respect to the longitudinal median plane 4, mutually connected on the top to an upper surface 14, for example planar and perpendicular to plane 4, while the side surfaces 12 and 13 are connected on the bottom to the upper surface 8 and to the upper surface 9, respectively. Axis 3 is secant to surfaces 12 and 13.

Located on both sides of the rib or the localized projection 7 is a bore 15 having a peripheral cylindrical surface of revolution 16 around axis 3 with a diameter such that the bore 15 is situated between surfaces 8 and 9 of the upper surface of ski 1, on the one hand, and the upper surface 14 on the other hand.

Figure 3:
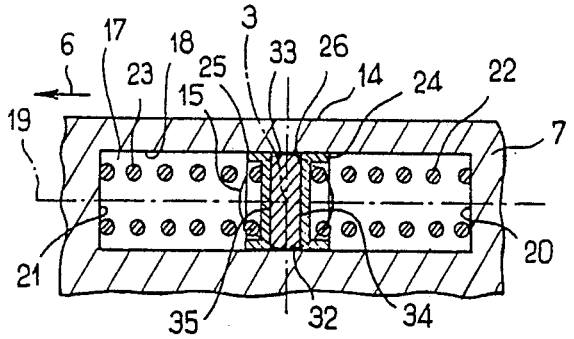
FIG. 3 illustrates a cross sectional view through plane III—III of FIG. 2, constituting a median longitudinal plane of the ski.
Figure 6:
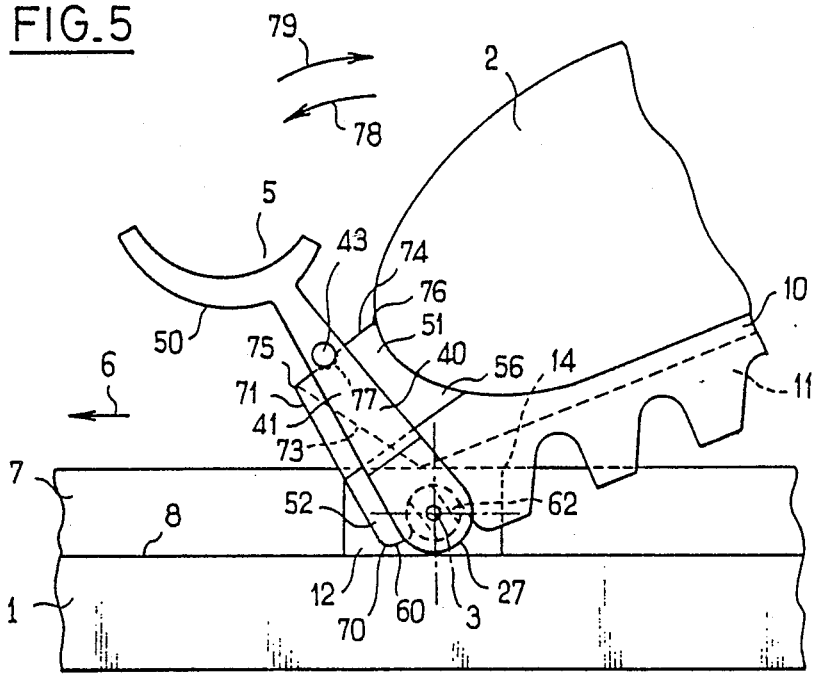
FIG. 6 illustrates, in a view similar to that of FIG. 1, one position of the binding while, in the course of practicing cross-country skiing, the heel (not shown) of the boot is lifted with respect to the ski.

As can be seen in FIGS. 3 and 6, in addition to the transverse bore 15, rib 7 or the localized projection, is a longitudinal bore 17 defining a peripheral cylindrical surface of revolution 18 around a longitudinal axis 19. Bore 17 is situated in the longitudinal median plane 4 of the ski, horizontally if one refers to the position illustrated, and is perpendicular to axis 3 such that bore 15 opens into bore 17 within rib 7, or the localized projection. In the example illustrated, the diameter of surface 18 is greater than that of surface 16 remaining not reach the upper surface 14. However, identical diameters can likewise be adopted, as well as a diameter of surface 18 less than that of surface 16.

Respectively on both sides of its intersection with bore 15, at distances which are respectively identical from axis 3, bore 17 is closed by end surfaces 20 and 21 which, e.g., are planar and perpendicular to axis 19. On these end surfaces 20 and 21 rest respective ends of helical springs 22 and 23 along axis 19 which are positioned in bore 17 respectively on both sides of axis 3. The other ends of springs 22 and 23 rest against respective pistons 24 and 25 which are flat and perpendicular to axis 19, and are slidably guided along axis 19 within bore 17. It may be desirable to have springs 22 and 23 adjustably tensioned by virtue of means not shown, but which would be within the capability of one of ordinary skill in the art.

Figure 4:
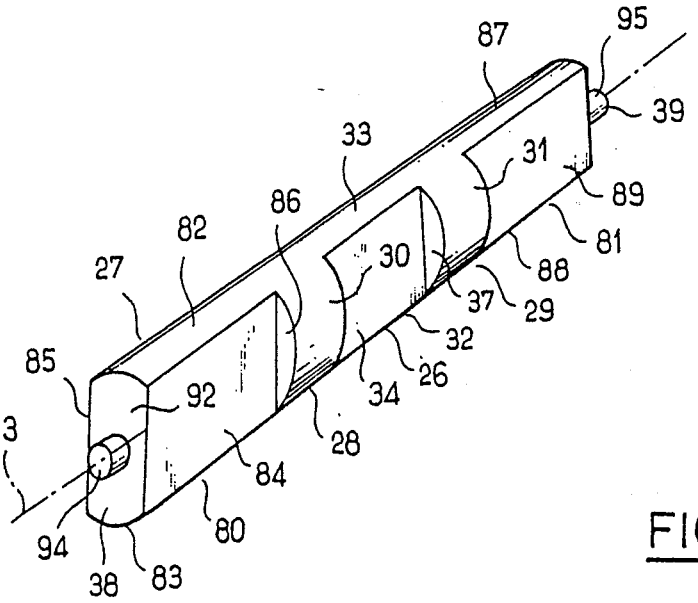
FIG. 4 illustrates the pin of the binding, in a perspective view.

Between pistons 24 and 25 is interposed a central section 26 of rectilinear pin 27 which is engaged along axis 3 in bore 15, and which is rotatable about axis 3 with respect to rib or the localized projection 7. To this end, as is shown more particularly in FIGS. 2 and 4, pin 27 has, respectively on both sides of its central section 26, two intermediate sections 28 and 29 which are defined by respective surfaces 30 and 31 which are cylinders of revolution around axis 3 with a diameter substantially identical to that of surface 16 of bore 15. The intermediate section 28 thus runs through bore 15 from the intersection thereof with bore 17 to surface 12 of rib or the localized projection 7. In a similar fashion, the intermediate section 29 runs through bore 15 from the intersection thereof with bore 17 to surface 13.

The central section 26 is only partially defined by a cylindrical surface of revolution around axis 3 with a diameter substantially identical to that of bore 15, i.e., by two surfaces 32 and 33 which are located in diametrically defined by two planar surfaces 34 and 35 which are parallel and symmetrical to one another. Surfaces 34 and 35 are connected to the respective cylindrical surfaces 30 and 31 of the intermediate sections 28 and 29 of pin 27 by planar surfaces 36 and 37 which are perpendicular to axis 3 and are parallel to the longitudinal median plane 4 of the ski. Surfaces 34 and 35 are symmetrical to one another with respect to plane 4 and have the same length along axis 3 which corresponds substantially to the diameter of bore 17 in a manner so as to be flush with surface 18 along axis 3.

The tension of springs 22 and 23 tends to press pistons 24 and 25 against the planar or flattened surfaces 34 and 35 of pin 27. This configuration defines a stable preferred orientation of pin 27 with respect to rib or projection 7 around axis 3 as illustrated in FIG. 3. In this stable position, flattened surfaces 34 and 35 are perpendicular to axis 19, and surfaces 36 and 37 of pin 27 form shoulders with respect to flattened surfaces 34 and 35, and rest against pistons 24 and 25 along axis 3 to prevent pin 27 from sliding along axis 3 in bore 15.

Figure 7:
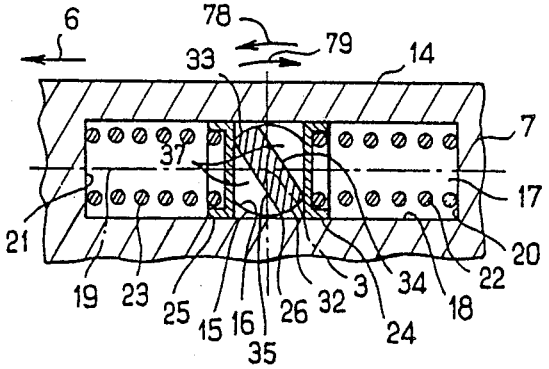
FIG. 7 illustrates one view of the binding such as it appears in FIG. 6 in cross section through a plane identical to plane III—III of FIG. 2.

However, as is shown for example in FIG. 7, it is possible to angularly displace pin 27, around axis 3, from this stable position, particularly in a direction 78 directed frontwardly above axis 3, causing an increase in compression of springs 22 and 23 by a mutual spacing of pistons 24 and 25. As long as the angular displacement of pin 27 with respect to the stable position is such that pistons 24 and 25 remain supported by the central portion 26 of pin 27 by respective junctions of flattened surfaces 34 and 35 with the partial cylinder portions 32 and 33, pin 17 is restrained from sliding along axis 3 and springs 22 and 23 act upon pin 27 through pistons 24 and 25 with an elastic return couple in a direction 79 opposite to direction 78, towards the stable position illustrated in FIG. 3. These conditions correspond to the normal conditions of use.

In these normal conditions of use, pin 27 has, respectively on each side of rib or projection 7, two end surfaces 38 and 39 which are symmetrical to one another with respect to plane 4, and which are positioned, respectively, above surfaces 8 and 9.

Between each of the intermediate sections 28 and 29 and its closest respective end 38 or 39, pin 27 has a respective end section 80 or 81. When either end section is seen in cross section through a plane perpendicular to axis 3, it is at each point identical to that of section 26 through such a plane and, for example, through the longitudinal median plane 4 of the ski. In other words, two partial cylinder portions 82 and 83 are located in diametrically opposed positions with respect to axis 3 and are defined by a cylindrical surface of revolution around axis 3 and have the same diameter as surfaces 30 and 31 of the intermediate sections 28 and 29 as well as the surfaces 32 and 33 of the central section 26. The end section 80 of the pin 27 is defined by two planar surfaces 84 and 85 which are parallel to one another and are symmetrical to one another with respect to axis 3 and preferably coplanar, respectively, with surfaces 34 and 35 of central section 26 and define two flattened sections on the end section 80. These two surfaces 84 and 85 are connected to the cylindrical surface 30 of the intermediate section 28 of pin 27 by respective planar surfaces 86 which are perpendicular to axis 3 and which coincide substantially with surface 12 of rib or projection 7. Likewise, the end section 81 of pin 27 is defined, between two surfaces 87 and 88 which are diametrically opposed and symmetrical to one another with respect to axis 3, as having a cylinder of revolution around axis 3 and a diameter identical to that of surfaces 30 and 31 and of surfaces 32, 33, 82, 83 by two planar surfaces 89 and 90 which are parallel and symmetrical to one another with respect to axis 3, and respectively coplanar with the planar surfaces 84 and 85 to define two flattened portions and 90 are connected to cylindrical surface 31 of intermediate section 29 of pin 27 by respective planar surfaces 91, which are coplanar and perpendicular to axis 3 coinciding substantially with surface 13 of rib or projection 7.

At ends 38 and 39, pin 27 is likewise defined by planar end surfaces 92 and 93 which are perpendicular to axis 3. Each surface has a respective cylindrical swivel 94, 95 projecting therefrom and preferably is formed as one piece with pin 27.

Through swivels 94 and 95 on ends 38 and 39, the pin 27 carries a U-shaped stirrup 40 comprising two arms 41 and 42 connected by a rectilinear transverse member 43, which is parallel to axis 3, at a level above that of axis 3 in normal conditions of use.

More specifically, arms 41 and 42 of stirrup 40 are positioned on either side of rib or projection 7. Each of the arms 41 and 42 has a lower end portion, respectively 44 and 45, each of which contains a bore co-axial with axis 3 within which respective ones of swivels 94 and 95 engage. Near the respective end portions 44 and 45, the two arms 41 and 42, in the example illustrated, have planes parallel to the longitudinal median plane 4 of the ski and rest respectively against end surfaces 92 and 93 of pin 27, and are freely rotatable around axis 3. Between these lower end portions 44 and 45 and their connection with transverse member 43, the two arms 41 and 42 are bent, respectively at 46 and 47, beyond which they are planar and converge upwardly symmetrically toward and with respect to plane 4. With such a configuration, the two arms 41 and 42 extend beyond transverse member 43 to respective upper end portions 48 and 49 where they are connected to a reinforcement member 50 which has a concavity directed upwardly and which is adapted to receive the point of a ski pole during removal of the boot, This becomes clearer from FIG. 5 and as will be described below. Preferably, the two arms 41 and 42 are formed as a single piece member 50, however other embodiments are possible without going beyond the scope of the present invention. Likewise, arms 41 and 42 can have different shapes from the shape described. For example, they could be planar and parallel with respect to plane 4, from the lower end portions 44 and 45 to the upper end portions 48 and 49. Likewise, transverse 43 can be constituted by reinforcement member 50 which is carefully constructed to perform the function of transverse member 43 and which will be described below.

To cooperate with pin 27 of stirrup 40, sole 10 of boot 2 has a front end projection 51 which, for reasons of simplicity, will be described with reference to the position of the boot illustrated in FIGS. 1 and 2.

It is clear from these figures that end projection 51 which, for the most part is situated above rib or projection 7 and engaged within stirrup 40, between transverse member 43 of the latter, arms 41 and 42 and the upper surface 14 of rib or projection 7 is subdivided towards the front and bottom into two portions 52 and 53 which are symmetrical to one another with respect to the longitudinal median plane 4 of ski 1 and overlap respectively between surface 12 of rib or projection 7 and arm 41, and between surface 13 of rib or projection 7 and the arm 42 of stirrup 40, to rest respectively on the end section 80 of pin 27 and on the end section 81 of pin 27, outside of rib or projection 7.

More specifically, the two portions 52 and 53 have facing, planar surfaces 54 and 55 which are parallel and symmetrical to one another with respect to plane 4. Surfaces 54 and 55 are spaced by a distance corresponding substantially to the spacing of surfaces 12 and 13 perpendicularly to plane 4 as well as the spacing surfaces 86 and 91 of pin 27 perpendicularly to plane 4, in a manner so as to establish sliding contact of surfaces 54 and 55 with surfaces 12 and 86, respectively, and with surfaces 13 constitute extensions of side surfaces of groove 11 of sole 10. End projection 51 includes lateral surfaces 56 and 57 which have a shape chosen to permit, respectively between surface 56 and arm 41 and between surface 57 and arm 42, free movement as shown at locations 58 and 59. This movement between stirrup 40 and end projection 51 is necessary for insertion and removal of the boot and will be described below.

Towards the bottom, surfaces 54 and 55 are connected respectively to surfaces 56 and 57 by side surfaces 60 and 61 which have openings therein respectively 62 and 63 which open downwardly and open respectively onto surfaces 54 and 56 and in surfaces 55 and 57.

Figure 5:
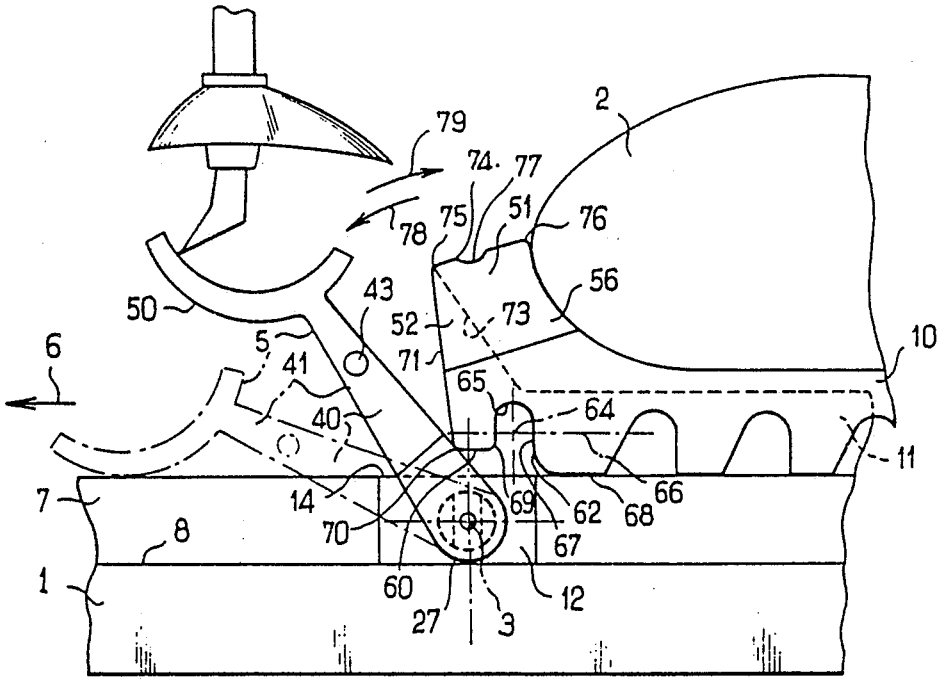
FIG. 5 illustrates the insertion or removal of the boot, in a view similar to that of FIG. 1.

As it will appear more particularly from FIG. 5, identical openings 62 and 63 are concentric with axis 64 which axis coincides with axis 3 in the position illustrated in FIG. 1. More specifically, each of openings 62 and 63 is defined by a peripheral surface having a top portion such as 65 in the shape of a cylinder of revolution around axis 64 and which is similar and complementary to that of surfaces 82 and 87 of the end sections 80 and 81 of pin 27 such that, when the boot occupies the position illustrated in FIG. 1, the top portion such as 65 mates respectively with the portion of surface 82 of section 80 and the portion of surface 87 of section 81 on each of portions 82 and 87 situated above the horizontal plane 66 passing through axes 3 and 64. Each of the peripheral surfaces of boot 2, such as 65, extends downwardly below plane 66 to the rear of axis 64, and is connected to a surface such as 67 which is planar and perpendicular to plane 66, which is then connected towards the bottom to the lower surface such as 68 of the sole, which is adapted to rest on the upper surface such as 8 in the position illustrated in FIG. 1. On the other hand, in front of axis 64, a surface such as 69 which is planar and perpendicular to plane 66 is connected at its lower end to a planar surface such as 70 which is parallel to plane 66, and is located between plane 66 and the lower surface of the sole such as 68. The surfaces such as 67 and 69, which are parallel to one another and placed in symmetrical positions with respect to axis 64, are spaced by a distance corresponding substantially to the spacing of the flattened surfaces 84 and 85 of section 80 of pin 27 and to that of the flattened surfaces 89 and 90 of the section 81 of the pin such that, in the position illustrated in FIG. 1, the surfaces such as 67 of openings 62 and 63 are flattened against the flattened surfaces 84 and 89, respectively, and the surfaces such as 69 of openings 62 and 63 are flattened against the flattened surfaces 85 and 90 respectively. This configuration ensures a fixed engagement between the end projection 51 of boot 2 and pin 27 to permit rotation of the boot around axis 3, with respect to ski 1.

Towards the front, the surfaces such as 70 are connected to respective front surfaces 71 and 72 of portions 52 and 53, which front surfaces in the example illustrated are planar but which can have any shape adapted so as not to interfere with the concurrent pivoting movement of boot 2 and stirrup 40 around axes 64 and 3, described below. Likewise, between surfaces 54 and 55, above the upper surface 14 of rib or projection 7, end projection 51 is defined by a front surface 73 whose shape is adapted so as not to interfere with such movements and, for example, is planar with an orientation appropriately selected for this purpose.

Towards the top, the front respective surfaces 71 and 72 of portions 52 and 53 as well as surfaces 54, 55, 56 and 57 and the front surface 73 are connected to an upper surface 74 of end projection 51, which surface 74 is for example planar and parallel to the axis 64 and, in the position illustrated in FIG. 1, ascends towards the rear in a manner so as to have a front end 75 spaced with respect to axes 3 and 64 less than the spacing of the transverse member 43 from axis 3, and a rear end 76 spaced with respect to axes 3 and 64 greater than the spacing of the transverse member 43 from axis 3. In an intermediate zone between front end 75 and rear end 76 in which the spacing between the upper surface 74 of end projection 51 and the axis 64 is greater than the spacing separating the transverse member 43 and axis 3, upper surface 74 is provided with a rectilinear groove 77 which is parallel to axis 64 and transverse member 43 is engaged in the position illustrated in FIG. 1 due to the elasticity of end projection 51. This engagement can be effected by the inherent elasticity of stirrup 40 and/or end projection 51. Groove 77 is spaced from axis 64 by a distance at least equal to the distance separating transverse member 43 from axis 3. This engagement ensures the retention of end projection 51 by way of openings 62 and 63 on end sections 80 and 81 of pin 27.

The operation of binding 5 which has just been described is as follows.

It will be assumed initially that ski 1 does not have the boot 2 inserted therein. Pin 27 then occupies the position illustrated in FIG. 3 as well as in FIGS. 1 and 5 in which the planar or flat surfaces 34 and 35, and the planar or flat surfaces 84, 85, 89 and 90 are perpendicular to axis 19, i.e., vertical in the illustrated example. On the other hand, stirrup 40, which is free to rotate around axis 3, rests freely on ski 1, on rib 7 thereof in the illustrated, by engagement with the reinforcement member 50 and/or the transverse member 43 positioned forwardly of axis 3, as it is schematically shown in dashed lines in FIG. 5.

To insert the boot, the skier engages, by a descending movement of boot 2 towards ski 1, openings 62 and 63 respectively with sections 80 and 81 of pin 27, between arms 41 and 42 of stirrup 40, resulting in a sliding of surfaces such as 67 against flat surfaces 84 and 89 and of surfaces such as 69 against flat surfaces 85 and 90 along a radial direction with respect to axis 3 until axes 64 and 3 become co-axial. The portions such as 65 of the peripheral surfaces of the two openings 62 and 63 thus tightly mate with the respective upper surfaces 82 and 87 of the end sections 80 and 81 of pin 27 without the possibility of relative rotation around co-axial axes 64 and 3 and without the possibility of relative parallel displacement of axis 3 by virtue of the fact that the surfaces 54 and 55 are respectively applied against the surfaces 12 and 86 and against the surfaces 13 and 91.

The skier can then exert a force on reinforcement member 50 to cause a pivoting of stirrup 40 in direction 79, i.e., towards the position illustrated in FIG. 1. In the course of this movement the transverse member 43 crosses without difficulty the front end 75 of the upper surface 74 of end projection 51 and becomes engaged in groove 77 of surface 74. Binding 5 thus assumes the position illustrated in solid lines in FIG. 1 in which stirrup 40 is, for example, slightly forwardly oriented with respect to axis 3.

When, in the course of cross-country skiing, the skier lifts his heel with respect to the ski as is shown in FIG. 6, stirrup 40 remains engaged with end projection 51 and rotatably moves therewith with respect to the ski around coaxial axes 64 and 3, by ensuring the retention of end projection 51 on end sections 80 and 81 of pin 27 by means of openings 62 and 63. The engagement of surfaces 54 and 55 against surfaces 12 and 13 furthermore ensures the lateral retention of boot 2 with respect to the ski. As a result, end projection 51 remains affixed to pin 27 with respect to rotation around axis 3 with respect to ski 1, so that pin 27 assumes an orientation like that illustrated in FIG. 7. Springs 22 and 23 become more compressed and, via pin 27, create a return moment to urge the boot 2 towards the position illustrated in FIG. 1. This return moment increases in proportion to the increase of rotation of boot 2 with respect to ski 1 in direction 78.

When the skier desires to remove his boot, he positions it flat on the ski, as is illustrated in FIG. 1, which allows stirrup 40 to reassume the position illustrated and the pin 27 to reassume the orientation illustrated in FIG. 3. By applying a force through the point of his pole in direction 78 to reinforcement member 50, as is illustrated in FIG. 5, the skier can cause a pivoting of stirrup 40 until the surface 74 of end projection 51 is freed from transverse member 43, which then permits him to lift his foot to disengage openings 62 and 63 from end sections 28 and 29 of pin 27. The stirrup falls freely in direction 78 towards the position illustrated in dashed lines in FIG. 5 as soon as transverse member 43 is disengaged from groove 77.

The embodiment which has just been described is only one non-limiting example of the invention, and one of ordinary skill in the art could imagine numerous variations without going beyond the scope of the present invention.

In particular, one could adopt, without going beyond the scope of the present invention a different support mode of the stirrup on a front end portion of the boot, for example, by replacing the transverse member of the stirrup by any equivalent means provided on the latter to be supported in an analogous fashion on a front end portion of the boot and/or by eliminating the front end projection of the boot to accomplish the functions previously described directly by the front end of the boot itself.

Finally, although the invention has been disclosed and described with reference to particular means, embodiments, and materials, it is to be understood that the invention is not limited to the particulars disclosed but extends to all equivalents within the scope of the claims.

We claim:

1. A binding for connecting a forward portion of a boot to a ski and for permitting rotation of said boot about a predetermined axis, said binding comprising:

(a) means for retaining said forward portion of said boot to said binding and for permitting said boot to be removed therefrom, said retaining means comprising (i) a transverse member for engagement with said forward portion of said boot and (ii) at least one first arm for extending laterally adjacent said forward portion of said boot and being connected to said transverse member;

(b) a pin positioned along said predetermined axis and connected to said first arm, said pin having (i) at least one section for substantially radial engagement and removable engagement with said forward portion of said boot through substantially complementarily shaped portions of said pin and said forward portion of said boot, and (ii) at least one guidance bearing portion for enabling rotation of said pin about said predetermined axis within a guidance bearing; and (c) means for elastically urging said pin and said boot toward a position corresponding to a support position of said boot substantially flat upon said ski.

2. A binding according to claim 1, wherein said forward portion of said boot comprises a front end projection for cooperating with said binding.

3. A binding according to claim 1, wherein said at least one first arm is rotatably mounted on said pin around said axis.

4. A binding according to claim 3, wherein said retaining means comprises a second arm for extending laterally adjacent said forward portion of said boot opposite to said first arm to define a U-shape with said first arm and said transverse member, and said pin is freely rotatable around said axis with respect to said second arm.

5. A binding according to claim 4, wherein each said first arm and said second arm is freely rotatably mounted on said pin around said axis.

6. A binding according to claim 5, wherein said at least one section for radial engagement and removable engagement to said forward portion of said boot is situated between said first arm and second arm.

7. A binding according to claim 6, wherein said at least one guidance bearing portion comprises two transversely spaced side portions and wherein said first arm and said second arm are positioned, respectively, beyond outer sides of said two side portions.

8. A binding according to claim 7, wherein there are provided two sections for radial engagement and removable engagement with said forward portion of said boot, one of said sections being located on each said side of said side portions.

9. A binding according to claim 7, wherein there are provided two sections for radial engagement and removable engagement with said forward portion of said boot which are located, respectively, between each of said first arm and said second arm and said at least one bearing portion.

10. A binding according to claim 1, wherein said ski comprises a rib and wherein said guidance bearing is located within said rib for engagement with said at least one guidance bearing portion of said pin.

11. A binding according to claim 1, wherein said means for elastically urging said pin comprises at least one flat surface on said pin and a compressible elastic means which is supported to transmit force against said at least one flat surface.

12. A binding according to claim 11, wherein said means for elastically urging said pin comprises at least one piston radially slidably mounted relative to said axis and wherein said compressible elastic means comprises at least one spring.

13. A binding according to claim 1, wherein said ski comprises a rib and wherein said means for elastically urging said pin is positioned within said rib.

14. A binding according to claim 1, wherein said forward position of said boot comprises at least one opening having at least one flat surface and wherein said at least one section for radial engagement and removable engagement with said forward portion of said boot comprises at least one flat surface on said pin formed to complementarily engage said at least one surface of said opening within said forward portion of said boot.

15. A ski binding comprising:

a pin for rotation relative to a support with respect to which said binding is to be mounted;

means for retention of said boot relative to said support, said retention means being operatively associated with said pin;

said pin having at least one surface that is arranged to cooperate with a portion of said boot so that said boot can rotate with said pin; and means operatively associated with said pin for returning said pin to an unrotated position of said boot and for opposing rotation of said pin.

16. A ski binding according to claim 15, wherein said retention means is arranged to rotate from a first position whereby said boot can be placed upon said support to a second position whereby said retention means engages said boot to affix said boot to said support.

17. A ski binding according to claim 16, wherein said retention means in said second position is adapted to engage an upper surface of said boot.

18. A ski binding according to claim 16 wherein, in said first position, said retention means is positioned forwardly, with respect to said ski, of said pin.

19. A ski binding according to claim 18, wherein said pin includes an axis of rotation and said retention means comprises at least a first arm connected to said pin for rotational movement about said axis.

20. A ski binding according to claim 19, wherein said retention means further comprises a second arm, said first arm and said second arm being connected to opposite ends of said pin for rotational movement about said axis.

21. A ski binding according to claim 20, wherein said first arm and said second arm each have a first end and a second end, each said first end being connected to opposite ends of said pin and a transverse member connecting said first arm and said second arm near each said second end.

22. A ski binding according to claim 21, wherein said transverse member is adapted to be activated by a skier to effect rotation of said retention means.

23. A ski binding according to claim 20, wherein said first arm and said second arm each have a first end and a second end, each said first end being connected to opposite ends of said pin and a transverse member connecting said first arm and said second arm remote from each said first end.

24. A ski binding according to claim 23, wherein said first and second arms extend beyond said transverse member toward said second ends, including a reinforcement member connecting said first and second arms near each of said second ends, whereby said reinforcement member is adapted to be contacted by a skier or a pole of a skier to effect rotation of said retention means.

25. A ski binding according to either of claims 24 or 22, wherein said transverse member is concave upwardly while in a position at which said boot is affixed to said ski by said retention position.

26. A ski binding according to claim 23, wherein said transverse member is adapted to be situated in a lowered forward position relative to a longitudinal axis of said ski in an unrotated position, and wherein said transverse member is adapted to be situated in a raised, rearward position relative to a longitudinal axis of said ski in a rotated position.

27. A ski binding according to claim 26, wherein in said rotated position, said transverse member engages an upper surface of a front end section of said boot.

28. A ski binding according to claim 27, wherein said upper surface of said front end portion of said boot includes a groove transverse to said longitudinal axis of said ski within which said transverse member is engaged in said rotated position.

29. A ski binding according to claim 28, wherein said upper surface of said boot includes at least a front end upper surface and a rear end upper surface, whereby the distance between said front end upper surface and said axis of said pin, when said retention means is in said rotated position, is less than the distance between said transverse member and said axis of said pin and whereby the distance between said rear end upper surface and said axis of said pin, when said retention means is in said rotated position, is greater than the distance between said transverse member and said axis of said pin.

30. A ski binding according to claim 29, wherein said groove is located in an intermediate region between said front end upper surface and said rear end upper surface.

31. A ski binding according to claim 27, wherein in said rotated position, said pin is engaged by said portion of said boot.

32. A ski binding according to claim 31, wherein said pin is generally cylindrical and said at least one surface of said pin is complementary to said portion of said boot.

33. A ski binding according to claim 32, wherein said pin cooperates with a lower surface of a front end projection of said boot to effect rotation of said pin by means of said boot.

34. A ski binding according to claim 33, wherein said pin includes opposite end seconds, each of which is adapted to cooperate with respective complementary portions of said boot to effect rotation therewith about said axis between said unrotated and rotated positions.

35. A ski binding according to claim 34, wherein said support comprises a rib and a guidance bearing located in said rib.

36. A ski binding according to claim 35, wherein said pin is journalled for rotation within said guidance bearing.

37. A ski binding according to claim 36, wherein said opposite end sections extend laterally beyond either side of said rib and wherein said respective complementary portions of said boot engage respective said opposite end sections of said pin.

38. A ski binding according to claim 37, wherein each of said complementary portions of said boot is adapted to be located laterally between one of said first and second arms and said rib.

39. A ski binding according to claim 38, wherein said opposite end sections each terminate at surfaces which act as means for preventing lateral displacement of said pin.

40. A ski binding according to claim 39, wherein said return means is fixed to said support.

41. A ski binding according to claim 40, wherein said return means comprises a compressible means, adapted to be compressed by the rotation of said pin in a first direction.

42. A ski binding according to claim 41, wherein said pin includes at least a first surface and said compressible means comprises a first compressible member and said first surface cooperates with said first compressible member.

43. A ski binding according to claim 42, wherein said first compressible member is positioned relative to said id first direction, said first compressible member is compressed to oppose rotation of said pin.

44. A ski binding according to claim 43, wherein compression of said compressible means is effected by rotation of said pin by said boot when said boot is affixed to said support by said retention means.

45. A ski binding according to claim 44, including a bore which communicates with said guidance bearing and said compressible means is located within said bore.

46. A ski binding according to claim 45, wherein said return means includes a piston means, said piston means comprising a first piston member which is positioned to contact said first surface of said pin.

47. A ski binding according to claim 46, wherein said first piston member is positioned between said first surface of said pin and said first compressible member so that, upon rotation of said pin in said first direction, said first piston member acts upon said first compressible member to compress it.

48. A ski binding according to claim 47, wherein said pin includes a second surface, said compressible means includes a second compressible member and said piston means includes a second piston member, wherein said second piston member is positioned between said second surface of said pin and said second compressible member so that, upon rotation of said pin in said first direction, said second piston member acts upon said second compressible member to compress it.

49. A ski binding according to claim 48, wherein said guidance bearing is located around a first axis and said bore is located around a second axis, said second axis being parallel to a longitudinal axis of said ski, perpendicular to said first axis.

50. A ski binding according to claim 32, wherein said at least one surface of said pin is planar.

51. A ski binding according to claim 50, wherein said planar surface of said pin cooperates with said portion of said boot to effect rotation of said pin by means of said boot.

52. A ski binding according to claim 15, wherein said pin is generally cylindrical and said at least one surface of said pin is complementary to said portion of said boot.

53. A ski binding according to claim 15, wherein said at least one surface of said pin is planar.

54. A ski binding according to claim 15, wherein said return means is fixed to said support.

55. A ski binding according to claim 54, wherein said return means comprises a compressible means adapted to be compressed by the rotation of said pin in a first direction.

56. A ski binding according to claim 55, including a guidance bearing within which said pin is located.

57. A ski binding according to claim 56, wherein said pin includes at least a first surface and said compressible means comprises a first compressible member and said first surface cooperates with said first compressible member.

58. A ski binding according to claim 57, wherein said first compressible member is positioned relative to said first surface of said pin so that, as said pin is rotated in said first direction, said first compressible member is compressed to oppose rotation of said pin.

59. A ski binding according to claim 58, wherein compression of said compressible means is effected by the rotation of said pin by said boot when said boot is affixed to said support by said retention means.

60. A ski binding according to claim 59, including a bore which communicates with said guidance bearing and said compressible means is located within said bore.

61. A ski binding according to claim 60, wherein said return means includes a piston means, said piston means comprising a first piston member which is positioned to contact said first surface of said pin.

62. A ski binding according to claim 61, wherein said first piston member is positioned between said first surface of said pin and said first compressible member so that, upon rotation of said pin in said first direction, said first piston member acts upon said first compressible member to compress it.

63. A ski binding according to claim 62, wherein said pin includes a second surface, said compressible means includes a second compressible member and said piston means includes a second piston member, wherein said second piston member is positioned between said second surface of said pin and said second compressible member so that, upon rotation of said pin in said first direction, said second piston member acts upon said second compressible member to compress it.

64. A ski binding according to claim 63, wherein said guidance bearing is located around a first axis and said bore is located around a second axis, said second axis being parallel to a longitudinal axis of said ski, perpendicular to said first axis.

65. A ski binding according to claim 15, wherein said pin cooperates with a lower surface of said boot.

66. A ski binding according to claim 15, wherein said pin cooperates with a lower surface of a front end projection of said boot.

* * * * *

UNITED STATES PATENT AND TRADEMARK OFFICE

CERTIFICATE OF CORRECTION

PATENT NO. : 4,900,052

DATED : Feb. 13, 1990

INVENTOR(S) : M. PROVENCE et al.

It is certified that error appears in the above-identified patent and that said Letters Patent is hereby corrected as shown below:

column 1, line 16, after "engage" insert ——the top of the end of the boot opposite the pin, which is——;

column 1, line 54, after "surfaces" insert ——between the pin and the boot, the return means opposes such——;

column 2, line 8, change "concomittantly" to ——concomitantly——;

column 2, line 24, after "reference" insert ——to a non-limiting embodiment, as well as the drawings which——;

column 4, line 38, after "remaining" insert ——nevertheless limited to the extent such that bore 17 does ——;

column 5, line 7, before "defined" insert ——opposed positions with respect to axis 3. It is furthermore——;

column 5, line 38, change "17" to ——27——;

column 6, line 13, after "portions" insert ——on the end section 81 of the pin 27. The two surfaces 89——;

column 6, line 57, insert ——member—— after "transverse";

column 7, line 19, after "13" insert ——and 91, respectively. Surfaces 54 and 55 can preferably——;

column 11, line 12, in claim 14, line 2 change "position" to ——portion——;

UNITED STATES PATENT AND TRADEMARK OFFICE

CERTIFICATE OF CORRECTION

PATENT NO. : 4,900,052

DATED : Feb. 13, 1990

INVENTOR(S) : M. PROVENCE et al.

It is certified that error appears in the above-identified patent and that said Letters Patent is hereby corrected as shown below:

column 12, line 52, in claim 34, line 2 change "seconds" to ——sections——; and column 13, line 20, in claim 43, line 3 change "id" to ——first surface of said pin so that, as said pin is rotated in said——.

Signed and Sealed this

Twenty-ninth Day of October, 1991

*Attest:*

HARRY F. MANBECK, JR.

*Attesting Officer*

*Commissioner of Patents and Trademarks*